US005620142A

United States Patent [19]

Elkas

[11] Patent Number: 5,620,142

[45] Date of Patent: Apr. 15, 1997

[54] JEWELED ORIFICE FOG NOZZLE

[76] Inventor: Michael V. Elkas, 28 Franklin St., Ramsey, N.J. 07446

[21] Appl. No.: 474,947

[22] Filed: Jun. 7, 1995

Related U.S. Application Data

[63] Continuation-in-part of Ser. No. 919,164, Jul. 23, 1992, abandoned.

[51] Int. Cl.[6] ..... B05B 1/26

[52] U.S. Cl. ..... 239/518; 239/596; 239/DIG. 19

[58] Field of Search ..... 239/518, 524, 239/DIG. 19, 591, 461, 512, 596

[56] References Cited

U.S. PATENT DOCUMENTS

| | | | |
|---|---|---|---|
| 921,205 | 5/1909 | Cramer | 239/524 |
| 1,761,422 | 6/1930 | Wagner | 239/512 |
| 1,940,171 | 12/1933 | Huss | 239/DIG. 19 |
| 2,009,932 | 7/1935 | Klotzman | 239/DIG. 19 |
| 2,540,663 | 2/1951 | Garey | 239/518 |
| 2,701,165 | 2/1955 | Bete et al. | 239/512 |
| 3,894,691 | 7/1975 | Mee | 239/524 |
| 4,150,794 | 4/1979 | Higgins | 239/596 |
| 4,244,521 | 1/1981 | Guse | 239/596 |
| 4,869,430 | 9/1989 | Good | 239/524 |
| 5,033,681 | 7/1991 | Munoz | 239/DIG. 19 |

FOREIGN PATENT DOCUMENTS

| | | | |
|---|---|---|---|
| 540399 | 9/1954 | Belgium | 239/518 |
| 0226611 | 11/1985 | Japan | 239/596 |
| 1376591 | 12/1974 | United Kingdom | 239/596 |

*Primary Examiner*—Lesley D. Morris
*Attorney, Agent, or Firm*—Robert Charles Beam, Esq.

[57] ABSTRACT

The present invention shows an improved pin jet nozzle for use in providing an evaporative fog consisting essentially of fluid particles having a diameter of less than fifty micrometers (50 μm.). In the preferred embodiment, the nozzle of the present invention comprises a base portion, a pin portion, and a nozzle insert component. In particular, the nozzle insert comprises:

an insert member comprising a hollow, generally cylindrical insert adapted to be held firmly within the outlet orifice of the base portion of a pin let nozzle; and, an orifice member held firmly within the generally cylindrical insert member, which orifice member comprises:

A. a wear-resistant material;

B. a central orifice with a diameter of six one-thousandths of an inch (0.006 in.); and, c. a high degree of concentricity, with a variance in the concentricity of the central orifice of less than two ten-thousandths of an inch (0.0002 in.).

22 Claims, 8 Drawing Sheets

COLD FOG SYSTEMS DROPLET ANALYSIS SHEET

Fig. 4

TEST METHOD: PHASE-DOPPLER ANEMOMETRY (PDA)
VERTICAL SPRAY DIRECTION
DISTANCE FROM NOZZLE: 150 MM

NOZZLE TYPE: COLD FOG
(4.1 KG/H AT 70 BAR) CF-005/1

PRESSURE: 70 BAR

| DIAMETER AVERAGE | SURFACE AREA TOTAL | SURFACE AREA ACCUMULATED % | VOLUME TOTAL | VOLUME ACCUMULATED % | VOLUME TO SURFACE AREA |
|---|---|---|---|---|---|
| 1,65 | 1.215 | 0,0 | 334 | 0,0 | 0,28 |
| 4,9 | 134.566 | 1,0 | 109.896 | 0,2 | 0,82 |
| 8,15 | 1.060.473 | 8,6 | 1.440.476 | 3,3 | 1,36 |
| 11,45 | 1.661.486 | 20,6 | 3.170.670 | 10,1 | 1,91 |
| 14,75 | 2.652.635 | 39,7 | 6.521.062 | 24,1 | 2,46 |
| 18 | 2.355.365 | 56,7 | 7.066.095 | 39,3 | 3,00 |
| 21,25 | 1.485.301 | 67,4 | 5.260.440 | 50,5 | 3,54 |
| 24,55 | 1.456.060 | 77,9 | 5.957.711 | 63,3 | 4,09 |
| 27,8 | 1.065.869 | 85,6 | 4.938.528 | 73,9 | 4,63 |
| 31,05 | 599.206 | 89,9 | 3.103.478 | 80,6 | 5,18 |
| 34,35 | 507.837 | 93,6 | 2.907.364 | 86,8 | 5,73 |
| 37,65 | 387.435 | 96,4 | 2.431.156 | 92,0 | 6,28 |
| 40,9 | 220.722 | 98,0 | 1.504.589 | 95,2 | 6,82 |
| 44,15 | 134.721 | 98,9 | 991.319 | 97,4 | 7,36 |
| 47,45 | 77.806 | 99,5 | 615.318 | 98,7 | 7,91 |
| 50,75 | 48.548 | 99,9 | 410.637 | 99,6 | 8,46 |
| 54 | 9.161 | 99,9 | 82.448 | 99,8 | 9,00 |
| 57,25 | 0 | 99,9 | 0 | 99,8 | #DIV/! |
| 60,55 | 11.518 | 100,0 | 116.236 | 100,0 | 10,09 |
| 63,8 | 0 | 100,0 | 0 | 100,0 | #DIV/! |
| 67,05 | 0 | 100,0 | 0 | 100,0 | #DIV/! |
| 70,35 | 0 | 100,0 | 0 | 100,0 | #DIV/! |
| 73,65 | 0 | 100,0 | 0 | 100,0 | #DIV/! |
| 76,85 | 0 | 100,0 | 0 | 100,0 | #DIV/! |
| | 13.870.425 | | 46.627.758. | | |

Fig. 7

COLD FOG SYSTEMS DROPLET ANALYSIS SHEET

TEST METHOD: PHASE-DOPPLER ANEMOMETRY (PDA)
VERTICAL SPRAY DIRECTION
DISTANCE FROM NOZZLE: 150 MM

NOZZLE TYPE: (4.1 KG / H AT 70 BAR) COLD FOG CF-005/1 PRESSURE: 70 BAR

ATTEMPTED SAMPLES: 25,760
VALIDATED SAMPLES: 20,000
DATA RATE: 7,297 KHZ
ELAPSED TIME: 3.53 SEC.

ARITHMETIC MEAN DIA.: 13,448 MICRONS
SURFACE MEAN DIA.: 14,915 MICRONS
VOLUME MEAN DIAMETER: 16,541 MICRONS
SAUTER MEAN DIAMETER : 20,080 MICRONS

| DIAMETER RANGE MICRONS | DROPLETS QTY. | DROPLETS % | SURFACE AREA % | VOLUME % | DROPLETS VELOCITY M / S |
|---|---|---|---|---|---|
| 0,0 - 3,3 | 142 | 0.7 | 0.0 | 0.0 | 9.27 |
| 3,3 - 6,5 | 1.784 | 8.9 | 1.0 | 0.2 | 8.63 |
| 6,5 - 9,8 | 5.082 | 25.4 | 7.6 | 3.1 | 8.48 |
| 9,8 - 13,1 | 4.034 | 20.2 | 12.0 | 6.8 | 8.54 |
| 13,1 - 16,4 | 3.881 | 19.4 | 19.1 | 14.0 | 8.5 |
| 16,4 - 19,6 | 2.314 | 11.6 | 17.0 | 15.2 | 8.44 |
| 19,6 - 22,9 | 1.047 | 5.2 | 10.7 | 11.3 | 8.24 |
| 22,9 - 26,2 | 769 | 3.8 | 10.5 | 12.8 | 8.25 |
| 26,2 - 29,4 | 439 | 2.2 | 7.7 | 10.6 | 8.05 |
| 29,4 - 32,7 | 198 | 1.0 | 4.3 | 6.7 | 7.73 |
| 32,7 - 36 | 137 | 0.7 | 3.7 | 6.2 | 7.87 |
| 36,0 - 39,3 | 87 | 0.4 | 2.8 | 5.2 | 7.52 |
| 39,3 - 42,5 | 42 | 0.2 | 1.6 | 3.2 | 7.56 |
| 42,5 - 45,8 | 22 | 0.1 | 1.0 | 2.1 | 7.1 |
| 45,8 - 49,1 | 11 | 0.1 | 0.6 | 1.3 | 8.19 |
| 49,1 - 52,4 | 6 | 0.0 | 0.4 | 0.9 | 6.65 |
| 52,4 - 55,6 | 1 | 0.0 | 0.1 | 0.2 | 5.92 |
| 55,6 - 58,9 | 0 | 0.0 | 0.0 | 0.0 | 0 |
| 58,9 - 62,2 | 1 | 0.0 | 0.1 | 0.2 | 4.99 |
| 62,2 - 65,4 | 0 | 0.0 | 0.0 | 0.0 | 0 |
| 65,4 - 68,7 | 0 | 0.0 | 0.0 | 0.0 | 0 |
| 68,7 - 72,0 | 0 | 0.0 | 0.0 | 0.0 | 0 |
| 72,0 - 75,3 | 0 | 0.0 | 0.0 | 0.0 | 0 |
| 75,3 - 78,5 | 0 | 0.0 | 0.0 | 0.0 | 0 |
| | 19,997 | 100,0 | 100,0 | 100,0 | |

JEWELED ORIFICE FOG NOZZLE

This application is a continuation-in-part of U.S. patent application Ser. No.: 07/919,164, filed Jul. 23, 1992, now abandoned.

BACKGROUND OF THE INVENTION

1. Field of the Invention

The present invention relates to a pin jet nozzle, or fog nozzle, for use in a pressurized evaporative cooling system. In particular, the present invention relates to an improved pin jet nozzle adapted for use in providing an evaporative fog consisting essentially of fluid particles having a diameter of less than fifty micrometers (50 μm.), said nozzle comprising:

a. a base portion itself comprising:
   i. means for connection of said nozzle to a pressurized hydraulic system;
   ii. means for receiving fluid from said system; and,
   iii. an orifice component, said orifice component comprising:
      A. an inlet adapted to receive fluid from said system;
      B. a outlet orifice for the release of fluid from said system in the form of a jet; and,
      C. a delivery channel adapted to convey fluid from said inlet to said outlet orifice; and, b. a pin portion itself comprising:
   i. support and centering means; and,
   ii. an impingement pin member mounted upon said support and centering means and positioned over said outlet orifice and having an impingement face in the path of said fluid jet which is substantially similar in dimension to the diameter of said fluid jet;

c. further comprising a nozzle insert comprising:
   i. an insert member comprising a hollow, generally cylindrical insert adapted to be held firmly within the outlet orifice of said base portion; and,
   ii. an orifice member held firmly within the generally cylindrical insert member, which orifice member comprises:
      A. a wear-resistant material;
      B. a central orifice with a diameter of from about three one-thousandths of an inch (0.003 in.) to about fifteen one-thousandths of an inch (0.015 in.); and,
      C. a high degree of concentricity, with a variance in the concentricity of said central orifice of less than five ten-thousandths of an inch (0.0005 in.).

2. Description of Related Art

Evaporative cooling systems have been employed in various applications for a number of years. Such systems typically involve a pressurized fluid, usually water, escaping through a small orifice and impinging on a proximate surface. The force of the pressurized stream against the proximate surface causes the fluid to disperse into minute particles creating a localized fog. A fog differs from a mist, although the terms are often used imprecisely. As used herein, a fog contains small droplets which evaporate from the air rather than falling to cause a localized wetting. Fogs are typically used for cooling, and sometimes, for humidification. A mist, as used herein, contains larger particles which fall to create a localized wetting, and are typically used more for providing irrigation.

Because of the difficulty in precisely cutting the small diameter orifice and delivery channel, such prior art nozzles have typically been formed from brass and other relatively soft metals because of the difficulty in working. Recently, some nozzles have been produced in stainless steel, however, such nozzles still follow the design of previous nozzles.

The short delivery channels of the prior art appeared to be necessary because of the limitations of metalworking. Cutting a narrow orifice, typically on the order of six one-thousandths of an inch (0.006 inch), is typically done with a pin drill, usually a stationary drill which engages rotating work. The depth which can be achieved with such a metalworking procedure, typically no greater than fifteen-thousandths of an inch (0.015 inch), is chiefly a function of how well the drill bit can be supported during the metal working process.

Further, and perhaps more important to the present invention, the nature of the metalworking employed to cut the orifice and delivery channel is such that the concentricity of the orifice and the integrity of the orifice and channel walls is difficult to maintain. The drilling operation is known to gouge and scar the interior surface of the delivery channel and leave an imprecise mouth to the orifice itself.

These problems were addressed in U.S. Pat. No. 4,869,430 to Good. That reference teaches the use of an insert cut from a length of stainless steel surgical tubing. While this reference overcomes many of the difficulties of the prior art, the internal diameter of such tubing is not always dimensionally accurate, and the metalworking of the cut ends of the tubing sometimes distorts the mouth of the orifice. Further, the extrusion process which draws such tubing is primarily concerned with the outside diameter of the finished tubing, and the inside diameter is often imprecise, with fluting and a lack of concentricity being common problems. Such fluting can cause collection of debris, while a lack of concentricity causes a variance in spray patterns. In either case, the variable flow which resulted from piece to piece variations meant that system flow volumes could not be accurately predicted.

Even with the improvements taught in the Good reference, however, it has been difficult, if not impossible, to predict the flow requirements of a system where a plurality of nozzles of different flow rates are employed. Such a situation has rendered it difficult to design efficient spray patterns and regular flow levels.

A pin-jet nozzle is used in a hydraulic system in which the water is pressurized to about 350 to 500 pounds per square inch. At that pressure a thin, substantially-coherent stream of water is forced out through an orifice which is a hole approximately six one-thousandths of an inch in diameter and against an external impingement pin, which is also about six one-thousandths of an inch in diameter, although it is common for larger size impingement pins to be employed.

This creates droplets that are small. Small droplets are essentially unaffected by gravity. They evaporate in the air rather than cause localized wetting. Each droplet's heat of vaporization is removed from the ambient air, reducing the ambient air temperature. An array of 200 to 300 of these nozzles can cool a large area, even an outdoor area.

Wetting was always the problem. Not only does wetting mean that cooling isn't being done efficiently, wetting can actually be harmful in many applications, by leading to mildew and mold, and damaging perishables, etc. A nozzle the puts out any significant number of large particles causes wetting, limiting the uses of the cooling system. Wear was one reason why nozzles did not perform in service, but manufacturing irregularities have been a much greater factor. The wear characteristics of a nozzle were unimportant if the nozzle could not be put into service in the first place.

The closest prior art to the present invention is U.S. Pat. No. 4,869,430 to Good. This reference shows a fog nozzle and it teaches directly away from our invention. The Good reference, which relies upon extrusion technology, teaches the use of a long, narrow delivery channel to improve the quality of the stream of fluid issuing from the nozzle's orifice.

U.S. Pat. No. 1,940,171 to Huss teaches the use of a diamond orifice, but the Huss reference relies upon drilling, the only technology available at the time of the reference, and does not show an orifice on the order of magnitude of the present invention; that is, six one-thousands of an inch in diameter. Applicant is not aware of anyone, anywhere, who can drill a six one-thousandths of an inch hole in a diamond, ruby or sapphire.

In fact, in 1988, when the Good reference was filed, the fog nozzle industry was only barely capable of drilling such a hole in brass, and learning to drill stainless.

The device of the Huss reference differs in several important respects:

It is a completely different magnitude—an oil burner does not require droplets having a particle size of the present invention;

It is an atomizing nozzle—the flow is swirled around internally, giving the particles a high tangential velocity, to create the greatest possible dispersion and mixing with the air—therefore, an efficient combustion.

It is a high temperature environment—the oil coming from the nozzle is burned.

The Huss reference deals with a different alignment problem—the alignment problem in the Huss reference is internal, and has nothing to do with the orifice insert.

The wear problem the Huss reference addresses is different—hardly surprising that a high-molecular weight oil with various impurities, at high tangential velocities in a high-temperature environment, would create a wear problem on the orifice.

The nozzle of the Huss reference is not a fog nozzle—It is doubtful if the pieces could be made on the scale of a fog nozzle (particularly the diamond insert), or that a fog would result if it were to be done.

SUMMARY OF THE INVENTION

It is an object of the present invention to provide a pin jet nozzle having a delivery channel with an interior surface unmarked by metalworking.

It is a further object of the present invention to provide an improved pin jet nozzle having an orifice mouth of greater integrity.

The other objects, features and advantages of the present invention will become more apparent in light of the following detailed description of the preferred embodiment thereof.

According to the preferred embodiment of the present invention, there is provided an improved pin jet nozzle adapted for providing an evaporative fog consisting essentially of fluid particles having a diameter of less than fifty micrometers (50 μm.), said nozzle comprising:

a. a base portion itself comprising:
   i. means for connection of said nozzle to a pressurized hydraulic system;
   ii. means for receiving fluid from said system; and,
   iii. an orifice component, said orifice component comprising:
      A. an inlet adapted to receive fluid from said system;
      B. an outlet orifice for the release of fluid from said system in the form of a jet; and,
      C. a delivery channel adapted to convey fluid from said inlet to outlet orifice; and, b. a pin portion itself comprising:
   i. support and centering means; and,
   ii. an impingement pin member mounted upon said support and centering means and positioned over said outlet orifice and having an impingement face in the path of said fluid jet which is substantially similar in dimension to the diameter of said fluid jet;

c. further comprising a nozzle insert comprising:
   i. an insert member comprising a hollow, generally cylindrical insert adapted to be held firmly within the outlet orifice of said base portion; and,
   ii. an orifice member held firmly within the generally cylindrical insert member, which orifice member comprises:
      A. a wear-resistant material;
      B. a central orifice with a diameter of from about three one-thousandths of an inch (0.003 in.) to about fifteen one-thousandths of an inch (0.015 in.).

BRIEF DESCRIPTION OF THE DRAWINGS

FIGS. 3 to 9 shown, in tabular and graphic form, the results of Phase-Doppler Anemometry analysis of the droplet dispersion of the nozzle of the present invention.

DETAILED DESCRIPTION OF THE PREFERRED EMBODIMENT

As with any pressurized discharge, the length and integrity of the cylindrical barrel from which the discharge issues will help determine the quality of its trajectory. This was true in the days of the "Pennsylvania" rifle and remains true today. The necessities of metalworking in the manufacture of a pin jet nozzle have, in the past, limited the length of the delivery channel, or barrel, of the nozzle. The integrity of the interior surface of the delivery channel and the orifice opening itself are also typically compromised by such metalworking.

Figure 1:
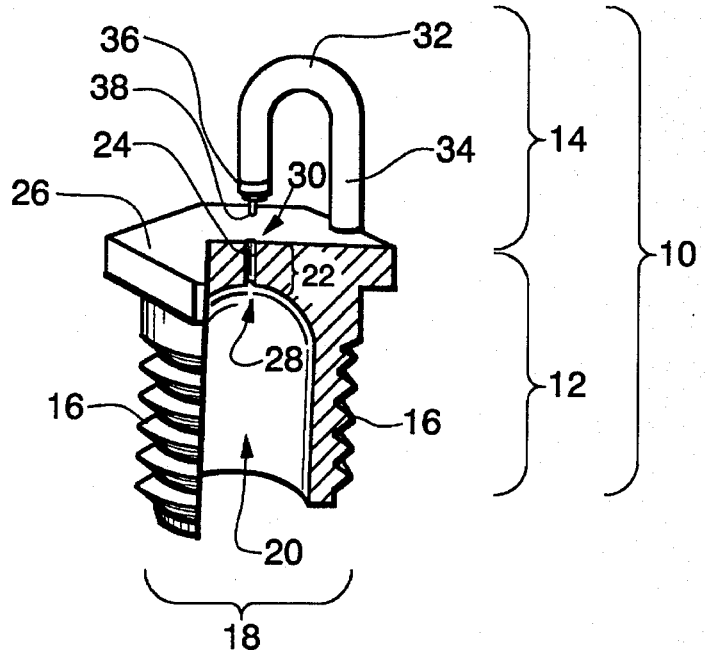
Fig. 1 PRIOR ART
FIG. 1, partly in cross section, shows the pin jet nozzle of the prior art.

In the prior art nozzle, as shown in FIG. 1, a pin jet nozzle (10) is generally comprised of a base portion (12) and a pin portion (14). The base portion further comprises means for the connection of the nozzle to a pressurized hydraulic system (not shown), which means are represented as the screw threads (16). These screw threads (16) enable the nozzle to be directly connected into such a system, but other means are well known to the art and many are shown in other references. The open bottom (18) of the base portion (12) and an internal chamber (20) serves as a means for receiving fluid from the hydraulic system.

The base portion (12) is further provided with a simplistic orifice component (22), consisting of a short delivery channel (24) drilled through the cap (26) of the base portion (12). This orifice component (22) further comprises an inlet (28) and an outlet orifice (30).

The pin portion (14) of the prior art nozzle (10) comprises a support and centering means (32), which is typically an arched post (34) affixed onto or into the cap (26), having at the terminal end (36) thereof an impingement pin (38) similar in diameter to the outlet orifice (30), and positioned directly outward to said orifice at a fixed distance.

The exact dimensions of the pin, its position and the geometry of its taper are believed to be within the knowledge of one skilled in the art.

To prepare a nozzle of the prior art design, a blank base portion is drilled with a pin drill which is, typically, six one-thousandths of an inch (0.006 inch) in diameter to provide the orifice. Such a drill is typically held in a stationary position while rotating stock is brought into and out of contact, allowing the drill to peck away until an orifice and delivery channel are cut. Because of the support requirements for such a narrow gauge drill, the length of the hole which may be obtained in this manner is severely limited, and rarely exceeds fifteen one-thousands of an inch (0.015 inch). Because of this shallow depth, the blank stock typically must be prepared by cutting an internal chamber sufficiently deep so that the drilling operation will reach the internal chamber to create an inlet for the orifice component.

Another hole is typically cut in the blank base to accommodate the arched post of the support and centering means, having an impingement pin at its terminal end. The depth to which the blank is cut in the previously described operation limits the depth to which the post hole can be drilled, thus somewhat limiting the support provided. An arched post is then affixed with the impingement pin centered above the outlet orifice as closely as possible. Because these holes are drilled at different times and on different equipment, alignment problems are an inherent difficulty.

Because of the nature of the drilling operation, the length, quality, and integrity of the delivery channel is severely limited. Such drilling is typically limited to about twice the diameter of the drill for practical machining purposes. The depth of a hole can exceed this limit with special machining techniques, which are difficult to maintain on a repetitive, cost-effective basis.

In addition, the drilling operation may leave gouging scars in the interior surface of the delivery channel and may chip away at the surrounding metal, leaving an imprecise mouth to the outlet orifice itself. These metalworking imperfections effect the concentricity and precision of the outlet stream of the fluid through the jet, and decrease the effectiveness of the nozzle.

U.S. Pat. No. 4,869,430 to Good, the disclosure of which is hereby incorporated by reference as if it were set forth in its entirety herein, shows an improved pin jet nozzle which addresses some of these problems. In that reference, a larger diameter hole is drilled in the cap of the base portion of a pin jet nozzle, preferably at the same time as the hole for the support and centering means. Into this larger hole is positioned an orifice component in the form of a portion of cut and polished stainless steel surgical tubing, having an interior diameter of six one-thousandths of an inch (0.006 inch). However, while the design of this reference was a substantial improvement over the prior art, variances in the extrusion process employed to produce the tubing introduced fluting and a lack of concentricity in the interior diameter, and imprecision of the orifice mouth. Further variances, which may be caused by cutting and polishing the tubing, limited the design.

The Good reference teaches the use of an insert cut from a length of stainless steel surgical tubing. While this reference overcomes many of the difficulties of the prior art, the internal diameter of such tubing is not dimensionally accurate, and the metalworking of the cut ends of the tubing sometimes distorts the mouth of the orifice. Further, the extrusion process which draws such tubing is primarily concerned with the outside diameter of the finished tubing which has good precision, and the inside diameter is often imprecise, with fluting and a lack of concentricity being common problems. No known extrusion technology is capable of extruding an internal diameter on the order of six one-thousandths of an inch (0.006 in.) with any precision, and the metal displaced in extruding the external diameter necks down and creates internal fluting. Such fluting can cause collection of debris, while a lack of concentricity causes a variance in spray patterns. In either case, the variable flow which resulted from piece to piece variations meant that system flow volumes could not be accurately predicted.

Flow rate variations as high as eighteen percent (18%) have been encountered in the prior art, and the nozzle of the Good reference has not been shown to improve upon the prior art in this regard.

Figure 2:
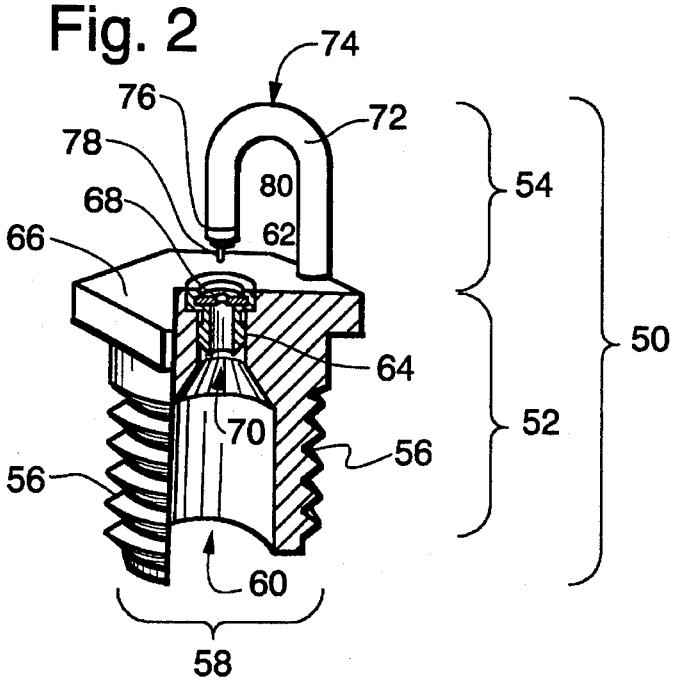
FIG. 2, partly in cross section, shows the improved pin jet nozzle of the present invention.

In the present invention, as shown in FIG. 2, a pin jet nozzle (50) is, like the prior art nozzle, generally comprised of a base portion (52) and a pin portion (54). The base portion further comprises means for connection of the nozzle to a pressurized hydraulic system (not shown), which means are represented as the screw threads (56). These screw threads (56) enable the nozzle to be directly connected into such a system, but other means well known to the art may alternatively be employed. As in the prior art, the open bottom (58) of the base portion (52) and an internal chamber (60) serve as a means for receiving fluid from the hydraulic system. A larger dimensioned orifice outlet (70) penetrates the cap (66) of base portion (52) in place of the tiny drilled hole of the prior art. This outlet orifice (70) is drilled through the cap (66) of the base portion (52), but drilling is not believed to be sufficiently accurate to effect a water-tight seal when a nozzle insert is positioned within the outlet orifice (70), and the drilled hole is reamed to remove irregularities and increase concentricity.

Although similar in function to the simplistic orifice component of the prior art, the nozzle of the present invention has an improved nozzle insert (62) penetrating the cap (66) of the base portion (52). The nozzle insert (62) comprises an insert member (64), and an orifice member (68).

Figure 2A:
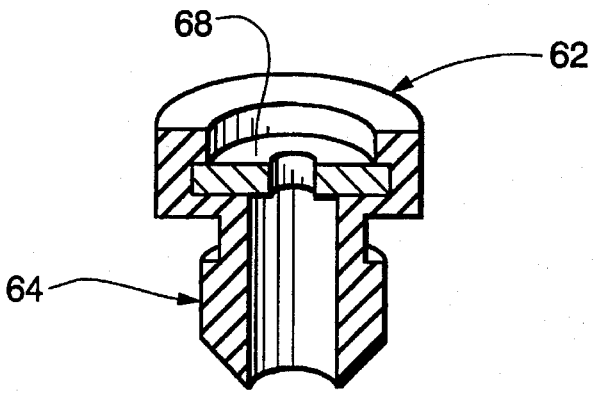
FIG. 2A, partly in cross section, shows greater detail of the nozzle insert of the present invention.
Figure 3:
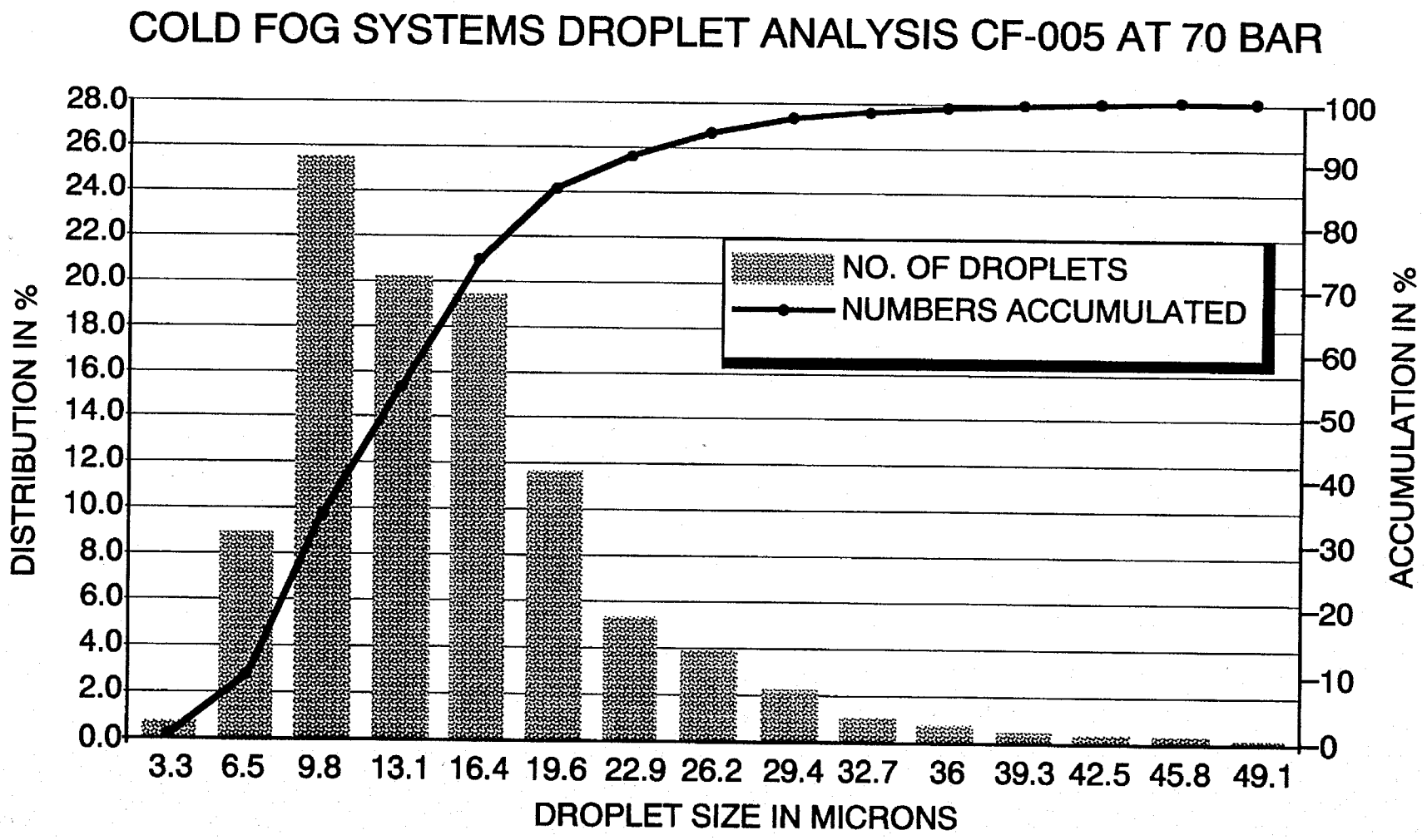
Figure 5:
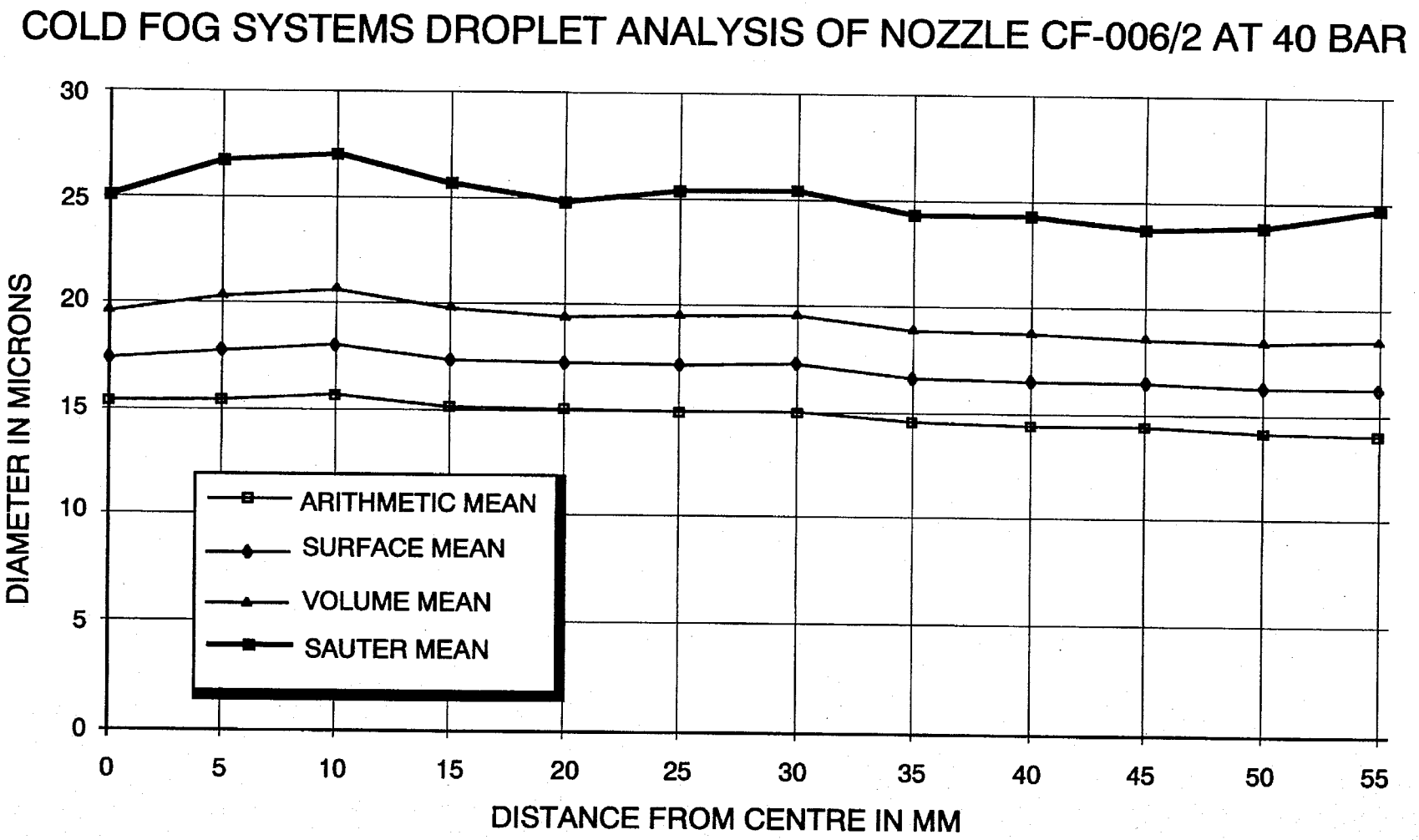
Figure 6:
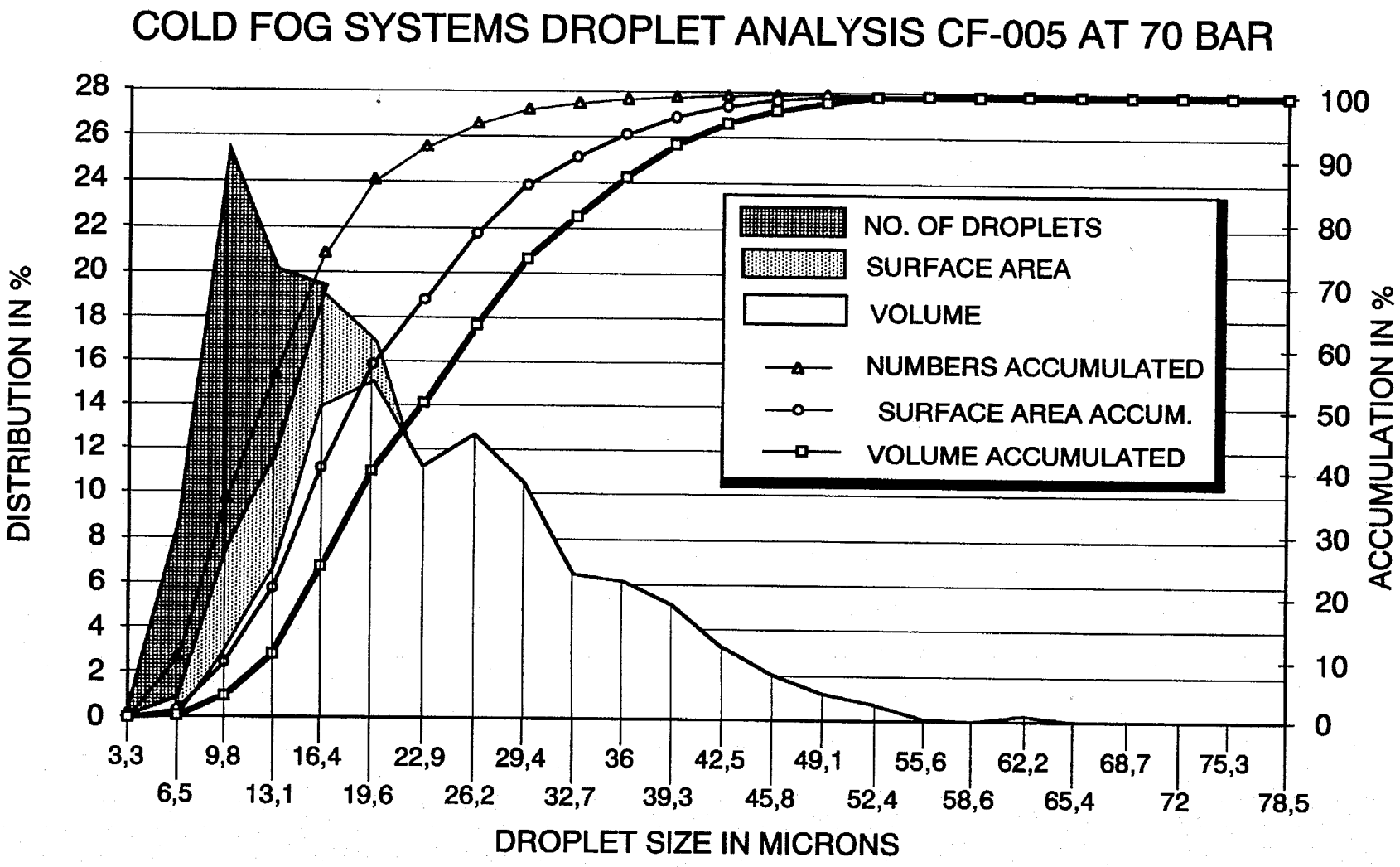
Figure 8:
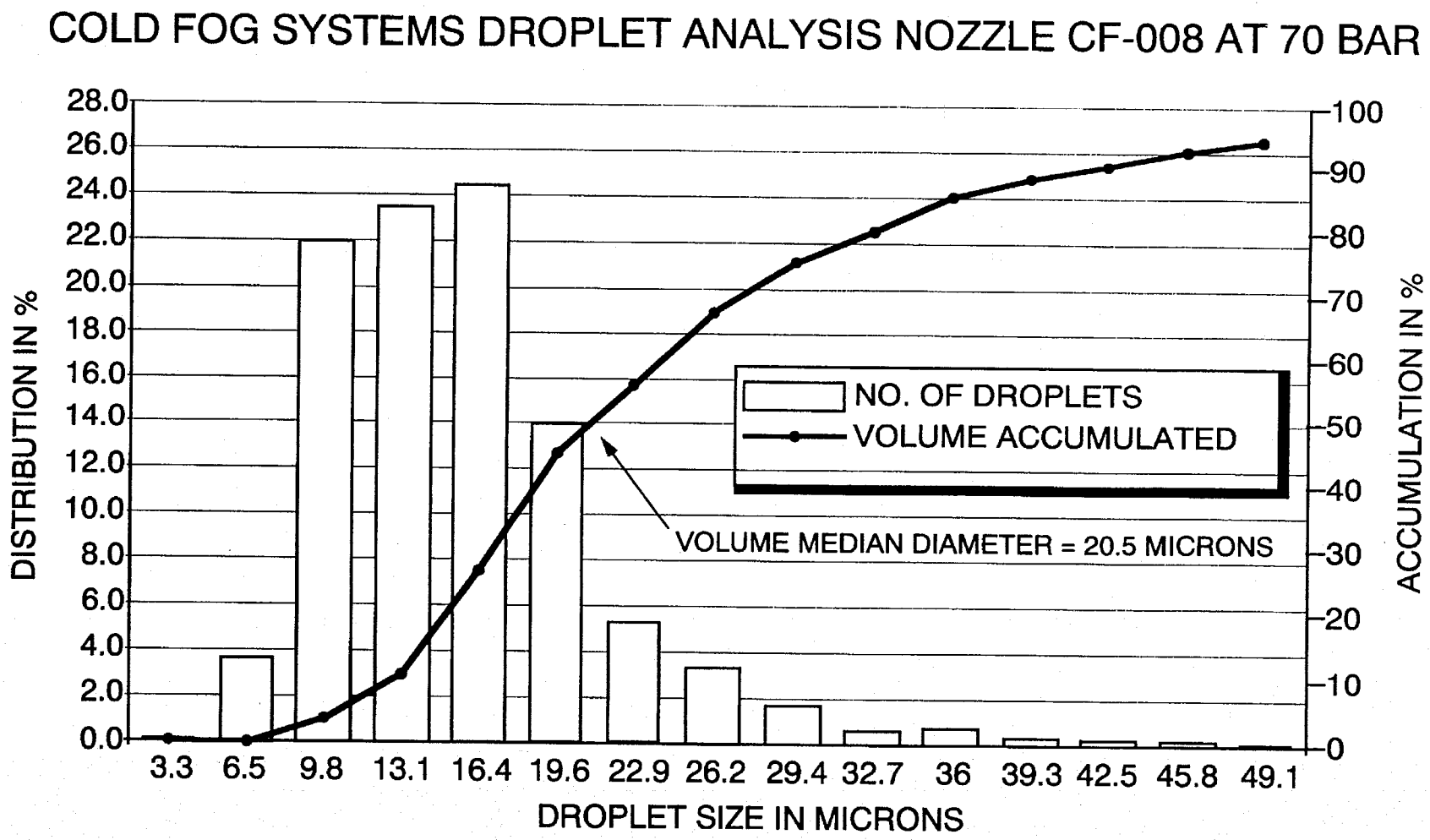
Figure 9:
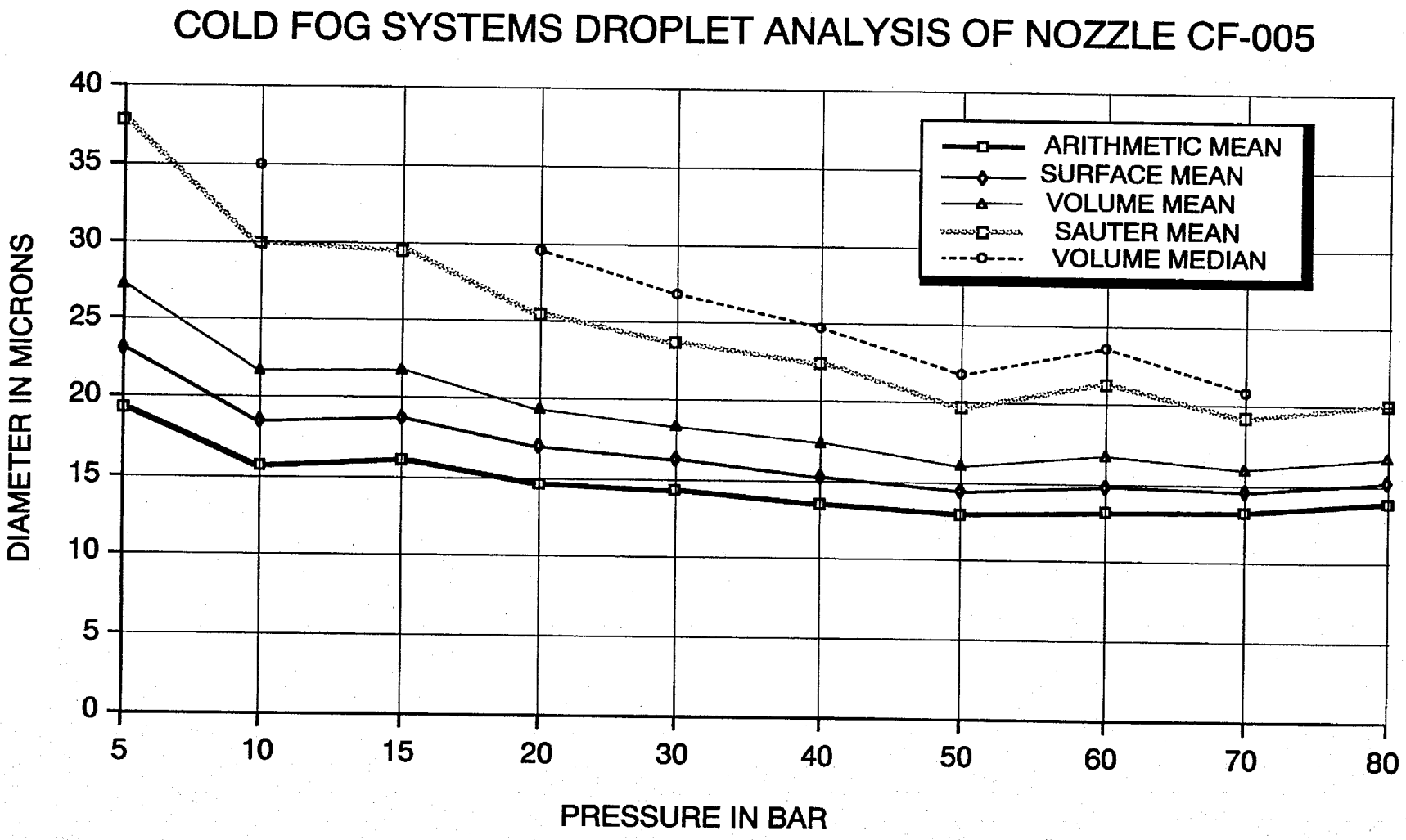

The nozzle insert (62) of the present invention is further illustrated in FIG. 2A. In that drawing, the insert member (64) may be seen to be a hollow, generally cylindrical insert adapted to be held firmly within the orifice outlet (70) of the base portion (52). This nozzle insert may be prepared from any suitable material, but nickel silver and stainless steel has been shown to work effectively for this purpose.

The orifice member (68) is also shown in greater detail in FIG. 2A. As illustrated, the orifice member (68) comprises a small element of wear-resistant material, such as artificial ruby or sapphire, or a similar material, and contains within it a central orifice of suitable diameter, and high inside diameter tolerance. The shape of the orifice member outside the central orifice area is not critical, but the flat disk illustrated has been shown to be preferred for ease in locating the orifice member (68) within the nozzle insert (62).

This orifice member (68) is prepared from a ruby or sapphire wafer to precise tolerances, including at least one surface which is smooth and polished with no surface pocketing, scarring, voids, or imperfections. A precise orifice mouth is cut with a laser, and then polished by wire polishing to a tolerance which is simply not possible with drilling or extrusion technology.

The orifice member (68) of the present invention is held firmly within the generally cylindrical insert member (64) as shown in the drawing, and this may be accomplished with standard metalworking techniques to expand a portion of the metal of insert member (64) over the surface of orifice member (68). The orifice member (68) should be held in a flat position, generally parallel to the nozzle surface. Other methods, which do not compromise the integrity of the orifice member, may be employed.

Referring to FIG. 2, once again, the pin portion (54) of the nozzle (50) of the present invention comprises a support and centering means (72) as in the prior art, which is typically an arched post (74) affixed onto or into the cap (66) of the base portion (52). The arched post (74) has at its terminal end (76) an impingement pin (78) with impingement face (80). By virtue of the tolerance of the orifice and the integrity of the orifice mouth, which define an exact output for each nozzle, the impingement pin (78) and the diameter of the impingement face (80) may be smaller in diameter than a comparable impingement pin of the pin jet nozzle of the prior art. It has been common in the prior art to provide an impingement pin larger in diameter than the outlet orifice. As in the prior art, the impingement pin is preferably positioned directly outward to the outlet orifice at a fixed distance.

Again, the exact dimension of the pin, its position and the geometry of its taper are believed to be within the knowledge of one skilled in the art.

To prepare a nozzle of the present invention, a blank base portion is drilled out to accommodate the insertion of a nozzle insert which is separately prepared. Thus, the blank base is not drilled with a pin drill, but with a drill of approximately six hundredths of an inch (0.06 inch). This drilling procedure, because of the great difference in size and because of the fact that it is not intended to define an opening in the finished nozzle, does not require the extreme accuracy of the drilling operation of the prior art.

The base may at the same time be drilled to accommodate the support and centering means of the pin portion and, because the blank need not be cut as deeply, the pin may be seated to a greater depth, adding to its strength and stability.

As noted previously, the nozzle insert is separately prepared from a machined insert member, into which an orifice member has been placed and secured, as described above. The nozzle insert (62) is then placed into the orifice outlet (70) and secured. In practice, this has been done by preparing the insert member (64) in a form which would permit it to be pressed into the orifice outlet (70) in a high tolerance press-fit engagement. This may be done by any method known to the art which will preserve the integrity of the inlet and the central orifice, and not compromise the fluid delivery.

Once the base portion of the nozzle has been assembled in this manner, the pin portion can be added in the manner of the prior art to provide the improved pin jet nozzle of the present invention.

The pin jet nozzle of the present invention represents a distinct improvement over the nozzles available to the prior art. The central orifice of the orifice member may be prepared with a tolerance as small as 0.0002 inch unknown to the prior art, while its wear-resistant characteristics provide a long service life of true dimensional stability not previously available. Further test results have shown that with an orifice of such true dimension, a smaller impingement pin can be employed, and less fluid is used to provide a better quality droplet dispersion in fogging.

Tests of the improved pin jet nozzle of the present invention have shown a greatly improved consistancy in flow rate. With an orifice of six one-thousandths of an inch, nozzles of the present invention can be represented to provide flows of from two hundred twenty ten-thousandths of a gallon per minute (0.0220 GPM) to about two hundred twenty-five ten-thousandths of a gallon per minute (0.0225 GPM). In testing, the improved pin jet nozzle of the present invention will consistantly deliver flows of two hundred twenty-one ten-thousandths of a gallon per minute (0.0221 GPM) to two hundred twenty-three ten-thousandths of a gallon per minute (0.0223 GPM).

Such reproducable flow rates compare very favorably with the prior art, where nozzle flows may vary as much as eleven percent (11%) to eighteen percent (18%) on a nozzle-to-nozzle basis. Such reproducibility is of great importance in the design of a system, where system capacities depend critically on the total output of several hundred such nozzles.

Equally valuable in the nozzle of the present invention is the ability to provide fluid droplets of limited particle size. As noted previously, in evaporative cooling applications, small particles evaporate rather than causing localized wetting. This is because the volume of the particle is smaller than its surface area (the cube of its diameter is smaller than the square of its diameter). With larger particles, however, wetting can occur, meaning that cooling is not occurring for such particles. As shown in the Phase-Doppler Anemometry results in FIGS. 3 through 9, the present invention is capable of providing a droplet dispersion in which approximately half of the droplets are smaller than fifteen micrometers (15 μm.). Further, about ninety percent of the droplets are smaller than thirty micrometers (30 μm.) and substantially all of the droplets are smaller than fifty micrometers (50 μm.).

Nothing in the prior art was capable of such small and uniform particle dispersion.

The nozzles of the present invention have enabled maintenance free systems in installations with difficult locations as, for example, a large botanical garden conservatory building with the nozzles installed as much as forty feet above the ground. Maintenance of nozzles can be required because of nozzle wear or clogging, and clogging is preventable by water treatment, making nozzle wear the only remaining concern. Nozzles of the present invention have been shown to greatly improve the service life, extending or eliminating the need for scheduled nozzle change-out, which has been common in many applications.

The present invention has permitted pin jet nozzle systems to replace air atomizing nozzles in many applications, including Heating, Ventilation and Air-Conditioning (HVAC). Because of the ability of the nozzles of the present invention to deliver consistant fine atomization with predictable flow rates, it is possible to eliminate air compressors in air atomizing systems at significant equipment savings.

Further, the present technology has permitted a proliferation of orifice sizes, as the beneficial capabilities of the present technology has found new application. Nozzles may now be produced commercially in sizes which were heretofore unknown or impossible. In this regard, nozzles has successfully been prepared with orifices of three thousandths of an inch (0.003 in.), thirty-five ten-thousandths of an inch (0.0035 in.), four thousandths of an inch (0.004 in.), five thousandths of an inch (0.005 in.), fifty-five ten-thousandths of an inch (0.0055 in.), six thousandths of an inch (0.006 in.), and twelve thousandths of an inch (0.012 in.).

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An improved pin jet nozzle adapted for use in providing an evaporative fog consisting essentially of fluid particles having a diameter of less than fifty micrometers (50 μm), said nozzle comprising:

a. a base portion itself comprising:
   i. means for connection of said nozzle to a pressurized hydraulic system;
   ii. means for receiving fluid from said system; and,
   iii. an orifice component, said orifice component comprising:
      A. an inlet adapted to receive fluid from said system;
      B. an outlet orifice for the release of fluid from said system in the form of a jet; and,
      C. a delivery channel adapted to convey fluid from said inlet to said outlet orifice; and, b. a pin portion itself comprising:
   i. support and centering means; and,
   ii. an impingement pin member mounted upon said support and centering means and positioned over said outlet orifice and having an impingement face in the path of said fluid jet which impingement face is substantially similar in dimension to the diameter of said fluid jet;

c. further comprising a nozzle insert comprising:
   i. an insert member comprising a hollow, generally cylindrical insert adapted to be held firmly within the outlet orifice of said base portion; and,
   ii. an orifice member held firmly within the generally cylindrical insert member, which orifice member comprises:
      A. a wear-resistant material;
      B. a central orifice with a diameter of from about three one-thousandths of an inch (0.003 in.) to about fifteen one-thousandths of an inch (0.015 in.);
      C. a high degree of concentricity, with a variance in the concentricity of said central orifice of less than five ten-thousandths of an inch (0.0005).

2. The pin jet nozzle of claim 1 wherein the insert member and orifice member are separately formed of dissimilar materials.

3. The pin jet nozzle of claim 1 wherein the insert member is comprised of nickel silver.

4. The pin jet nozzle of claim 1 wherein the insert member is comprised of stainless steel.

5. The pin jet nozzle of claim 1 wherein the orifice member is comprised, in principle part, of ruby.

6. The pin jet nozzle of claim 1 wherein the orifice member is comprised, in principle part, of sapphire.

7. The pin jet nozzle of claim 1 wherein the central orifice of the orifice member has a diameter of about three one-thousandths of an inch (0.003 in.).

8. The pin jet nozzle of claim 1 wherein the central orifice of the orifice member has a diameter of about thirty-five ten-thousandths of an inch (0.0035 in.).

9. The pin jet nozzle of claim 1 wherein the central orifice of the orifice member has a diameter of about four one-thousandths of an inch (0.004 in.).

10. The pin jet nozzle of claim 1 wherein the central orifice of the orifice member has a diameter of about five one-thousandths of an inch (0.005 in.).

11. The pin jet nozzle of claim 1 wherein the central orifice of the orifice member has a diameter of about fifty-five ten-thousandths of an inch (0.0055 in.).

12. The pin jet nozzle of claim 1 wherein the central orifice of the orifice member has a diameter of about six one-thousandths of an inch (0.006 in.).

13. The pin jet nozzle of claim 1 wherein the central orifice of the orifice member has a diameter of about twelve one-thousandths of an inch (0.012 in.).

14. The pin jet nozzle of claim 1 wherein the base portion is comprised, in principle part, of stainless steel.

15. The pin jet nozzle of claim 1 wherein the pin portion is comprised, in principle part, of stainless steel.

16. The pin jet nozzle of claim 1 wherein the variation in the concentricity of said orifice member is less three ten-thousandths of an inch (0.0003 in.).

17. The pin jet nozzle of claim 1 wherein the variation in the concentricity of said orifice member is less two ten-thousandths of an inch (0.0002 in.).

18. An improved pin jet nozzle adapted for use in providing an evaporative fog consisting essentially of fluid particles having a diameter of less than fifty micrometers (50 μm), said nozzle comprising:

a. a base portion itself comprising:
   i. means for connection of said nozzle to a pressurized hydraulic system;
   ii. means for receiving fluid from said system; and,
   iii. an orifice component, said orifice component comprising:
      A. an inlet adapted to receive fluid from said system;
      B. an outlet orifice for the release of fluid from said system in the form of a jet; and,
      C. a delivery channel adapted to convey fluid from said inlet to said outlet orifice; and, b. a pin portion itself comprising:
   i. support and centering means; and,
   ii. an impingement pin member mounted upon said support and centering means and positioned over said outlet orifice and having an impingement face in the path of said fluid jet which impingement face is substantially similar in dimension to the diameter of said fluid jet;

c. further comprising a nozzle insert comprising:
   i. an insert member comprising a hollow, generally cylindrical insert adapted to be held firmly within the outlet orifice of said base portion; and,
   ii. an orifice member held firmly within the generally cylindrical insert member, which orifice member comprises:
      A. a wear-resistant material;
      B. a central orifice with a diameter of about six one-thousandths of an inch (0.006 in.);
      C. a high degree of concentricity, with a variance in the concentricity of said central orifice of less than two ten-thousandths of an inch (0.0002).

19. The pin-jet nozzle of claim 18 in which the particle size of a substantial portion of the fog is below thirty micrometers (30 μm.) in diameter.

20. An improved pin jet nozzle adapted for use in providing an evaporative fog consisting essentially of fluid particles having a diameter of less than fifty micrometers (50

μm), and a consistant, reproducible flow rate from nozzle to nozzle, said nozzle comprising:

a. a base portion itself comprising:
   i. means for connection of said nozzle to a pressurized hydraulic system;
   ii. means for receiving fluid from said system; and,
   iii. an orifice component, said orifice component comprising:
      A. an inlet adapted to receive fluid from said system;
      B. an outlet orifice for the release of fluid from said system in the form of a jet; and,
      C. a delivery channel adapted to convey fluid from said inlet to said outlet orifice; and, b. a pin portion itself comprising:
   i. support and centering means; and,
   ii. an impingement pin member mounted upon said support and centering means and positioned over said outlet orifice and having an impingement face in the path of said fluid jet which impingement face is substantially similar in dimension to the diameter of said fluid jet;

c. further comprising a nozzle insert comprising:
   i. an insert member comprising a hollow, generally cylindrical insert adapted to be held firmly within the outlet orifice of said base portion; and,
   ii. an orifice member held firmly within the generally cylindrical insert member, which orifice member comprises:
      A. a wear-resistant material;
      B. a central orifice with a diameter of about six one-thousandths of an inch (0.006 in.);
      C. a high degree of concentricity, with a variance in the concentricity of said central orifice of less than two ten-thousandths of an inch (0.0002).

21. The pin jet nozzle of claim 20 in which the flow rate of said nozzle in a presurized hydraulic system is from about two hundred twenty ten-thousandths of a gallon per minute (0.0220 GPM) to about two hundred twenty-five ten-thousandths of a gallon per minute (0.0225 GPM).

22. The pin jet nozzle of claim 20 in which the flow rate of said nozzle in a presurized hydraulic system is from about two hundred twenty-one ten-thousandths of a gallon per minute (0.0221 GPM) to about two hundred twenty-three ten-thousandths of a gallon per minute (0.0223 GPM).

* * * * *